US009248345B2

(12) United States Patent
Parsons et al.

(10) Patent No.: US 9,248,345 B2
(45) Date of Patent: Feb. 2, 2016

(54) GOLF BALLS AND METHODS TO MANUFACTURE GOLF BALLS

(71) Applicant: Slick Golf, LLC, Scottsdale, AZ (US)

(72) Inventors: Robert R. Parsons, Scottsdale, AZ (US); Bradley D. Schweigert, Anthem, AZ (US)

(73) Assignee: Slick Golf, LLC, Scottsdale, AZ (US)

( * ) Notice: Subject to any disclaimer, the term of this patent is extended or adjusted under 35 U.S.C. 154(b) by 0 days.

(21) Appl. No.: 14/634,628

(22) Filed: Feb. 27, 2015

(65) Prior Publication Data

US 2015/0306461 A1 Oct. 29, 2015

Related U.S. Application Data

(63) Continuation-in-part of application No. 29/489,220, filed on Apr. 28, 2014, and a continuation-in-part of application No. 29/512,138, filed on Dec. 17, 2014, which is a continuation-in-part of application No. 29/511,214, filed on Dec. 8, 2014, which is a continuation-in-part of application No. 29/502,719, filed on Sep. 18, 2014, application No. 14/634,628, filed on Feb. 27, 2015, which is a continuation-in-part of application No. 29/508,853, filed on Nov. 12, 2014, which is a continuation-in-part of application No. 29/507,889, filed on Oct. 31, 2014.

(60) Provisional application No. 61/984,981, filed on Apr. 28, 2014, provisional application No. 62/009,820, filed on Jun. 9, 2014, provisional application No. 62/073,385, filed on Oct. 31, 2014, provisional application No. 62/111,812, filed on Feb. 4, 2015.

(51) Int. Cl.
*A63B 37/00* (2006.01)
*A63B 37/14* (2006.01)

(52) U.S. Cl.
CPC ..... *A63B 37/0004* (2013.01); *A63B 37/002* (2013.01); *A63B 37/0006* (2013.01); *A63B 37/0009* (2013.01); *A63B 37/0018* (2013.01)

(58) Field of Classification Search
CPC ..... A63B 37/0006; A63B 37/0007; A63B 37/0008; A63B 37/0009; A63B 37/002; A63B 43/008; A63B 43/06
See application file for complete search history.

(56) References Cited

U.S. PATENT DOCUMENTS 4,090,716 A 5/1978 Martin et al.
4,830,378 A 5/1989 Aoyama (Continued)

FOREIGN PATENT DOCUMENTS

JP 2003047674 A 2/2003
WO 9101163 A1 2/1991

OTHER PUBLICATIONS

U.S. Appl. No. 29/502,719, Schweigert, "Golf Ball," filed Sep. 18, 2014.

(Continued)

*Primary Examiner* — John E Simms, Jr.

(57) ABSTRACT

Embodiments of golf balls and methods to manufacture golf balls are generally described herein. In one example, a golf ball may include a plurality of round dimples and a plurality of non-round dimples. Each round dimple may have a dimple diameter, and each non-round dimple may have a dimple diagonal. Other examples and embodiments may be described and claimed.

20 Claims, 10 Drawing Sheets

(56) References Cited

U.S. PATENT DOCUMENTS

| | | | | |
|---|---|---|---|---|
| 4,869,512 | A * | 9/1989 | Nomura et al. | 473/383 |
| 4,936,587 | A | 6/1990 | Lynch et al. | |
| 5,013,046 | A * | 5/1991 | Koch | 473/200 |
| D328,626 | S | 8/1992 | Young et al. | |
| D329,075 | S | 9/1992 | Miller et al. | |
| 5,143,377 | A | 9/1992 | Oka et al. | |
| 5,158,300 | A | 10/1992 | Aoyama | |
| 5,174,578 | A | 12/1992 | Oka et al. | |
| D340,488 | S | 10/1993 | Aoyama | |
| D396,892 | S | 8/1998 | Kasasima | |
| D402,719 | S | 12/1998 | Kasasima | |
| 5,957,786 | A | 9/1999 | Aoyama | |
| D415,225 | S | 10/1999 | Asakura | |
| D430,241 | S | 8/2000 | Aoyama | |
| D430,628 | S | 9/2000 | Aoyama | |
| D432,190 | S | 10/2000 | Kasashima et al. | |
| D434,815 | S | 12/2000 | Asakura | |
| D435,071 | S | 12/2000 | Ogg | |
| D449,359 | S | 10/2001 | Ogg | |
| 6,358,161 | B1 | 3/2002 | Aoyama | |
| D484,203 | S | 12/2003 | Kasashima | |
| D506,234 | S | 6/2005 | Ninomiya et al. | |
| 6,905,426 | B2 | 6/2005 | Morgan et al. | |
| 6,916,255 | B2 | 7/2005 | Aoyama et al. | |
| 6,923,736 | B2 | 8/2005 | Aoyama et al. | |
| 6,945,880 | B2 | 9/2005 | Aoyama et al. | |
| D510,966 | S | 10/2005 | Michishita | |
| 7,033,287 | B2 | 4/2006 | Aoyama et al. | |
| 7,226,369 | B2 | 6/2007 | Aoyama et al. | |
| D546,910 | S | 7/2007 | Niwa | |
| 7,473,195 | B2 | 1/2009 | Aoyama et al. | |
| D588,215 | S | 3/2009 | Michishita | |
| 7,722,484 | B2 | 5/2010 | Morgan et al. | |
| D627,016 | S | 11/2010 | Madson et al. | |
| D627,838 | S | 11/2010 | Madson et al. | |
| D627,839 | S | 11/2010 | Madson et al. | |
| D645,920 | S | 9/2011 | Sato | |
| D645,921 | S | 9/2011 | Sato | |
| D646,736 | S | 10/2011 | Felker et al. | |
| D653,717 | S | 2/2012 | Sato | |
| 8,267,811 | B2 | 9/2012 | Morgan et al. | |
| 2003/0171167 | A1* | 9/2003 | Kasashima | 473/378 |
| 2003/0220158 | A1 | 11/2003 | Aoyama | |
| 2004/0082409 | A1 | 4/2004 | Kasashima | |
| 2005/0014579 | A1 | 1/2005 | Asakura | |
| 2005/0266934 | A1 | 12/2005 | Morgan et al. | |
| 2006/0068939 | A1 | 3/2006 | Sato et al. | |
| 2006/0172824 | A1* | 8/2006 | Nardacci et al. | 473/378 |
| 2007/0026971 | A1* | 2/2007 | Aoyama et al. | 473/378 |
| 2010/0240472 | A1* | 9/2010 | Nardacci et al. | 473/383 |
| 2011/0111887 | A1 | 5/2011 | Sullivan et al. | |
| 2012/0040778 | A1 | 2/2012 | Aoyama et al. | |
| 2012/0083365 | A1 | 4/2012 | Madson et al. | |
| 2012/0270684 | A1 | 10/2012 | Sajima et al. | |
| 2013/0172093 | A1 | 7/2013 | Leech | |
| 2014/0135146 | A1 | 5/2014 | Madson et al. | |

OTHER PUBLICATIONS

U.S. Appl. No. 29/507,889, Schweigert, "Golf Ball," filed Oct. 31, 2014.

U.S. Appl. No. 29/508,853, Schweigert, "Golf Ball," filed Nov. 12, 2014.

U.S. Appl. No. 29/511,214, Schweigert, "Golf Ball," filed Dec. 8, 2014.

U.S. Appl. No. 29/512,138, Schweigert, "Golf Ball," filed Dec. 17, 2014.

U.S. Appl. No. 29/489,220, Schweigert, "Golf Ball," filed Apr. 28, 2014.

* cited by examiner

GOLF BALLS AND METHODS TO MANUFACTURE GOLF BALLS

CROSS REFERENCE

This application claims the benefits of U.S. Provisional Application Ser. No. 61/984,981, filed Apr. 28, 2014, U.S. Provisional Application Ser. No. 62/009,820, filed Jun. 9, 2014. U.S. Provisional Application Ser. No. 62/073,385, filed Oct. 31, 2014, and U.S. Provisional Application No. 62/111,812, filed Feb. 4, 2015. This application is a continuation-in-part application of U.S. Non-Provisional application Ser. No. 29/489,220, filed Apr. 28, 2014. This application is also a continuation-in-part application of U.S. Non-Provisional application Ser. No. 29/512,138, filed Dec. 17, 2014, which is a continuation-in-part application of U.S. Non-Provisional application Ser. No. 29/511,214, filed Dec. 8, 2014, which is a continuation-in-part application of U.S. Non-Provisional application Ser. No. 29/502,719, filed Sep. 18, 2014. This application is also a continuation-in-part application of U.S. Non-Provisional application Ser. No. 29/508,853, filed Nov. 12, 2014, which is a continuation-in-part application of U.S. Non-Provisional application Ser. No. 29/507,889, filed Oct. 31, 2014. The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf balls and methods to manufacture golf balls.

BACKGROUND

Golf balls may vary in the total number of dimples formed on the outer surface (e.g., about 250 to 450 dimples). The dimples may be configured in different patterns (e.g., an icosahedral pattern, a tetrahedral pattern, an octahedral pattern, etc.). Further, the dimples may have different shapes (e.g., round, triangle, hexagon, etc.) and/or size (e.g., diameter and depth).

Figure 1:
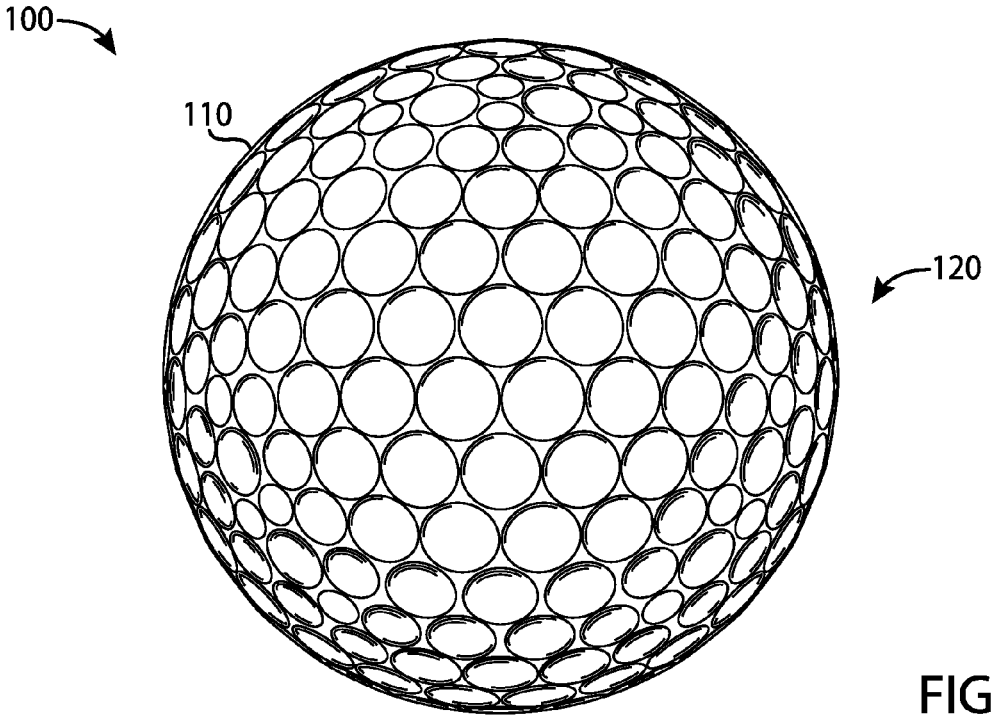
FIG. 1 is a front view of an example golf ball according to an embodiment of the apparatus, methods, and articles of manufacture described herein.
Figure 2:
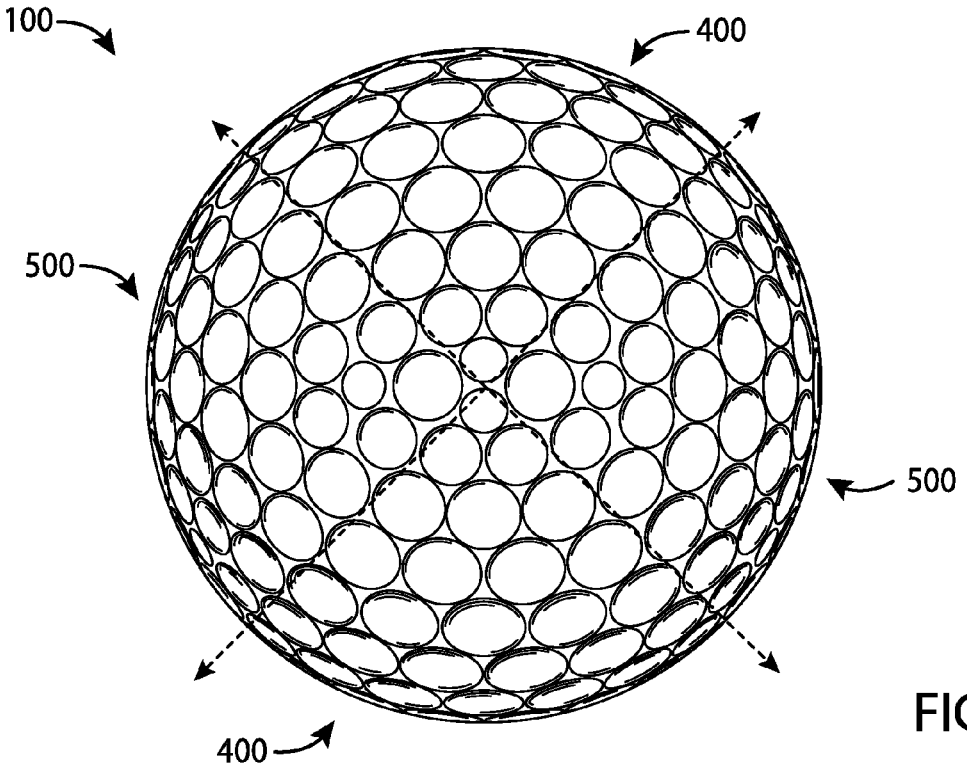
FIG. 2 depicts a top view of the example golf ball of FIG. 1.
Figure 3:
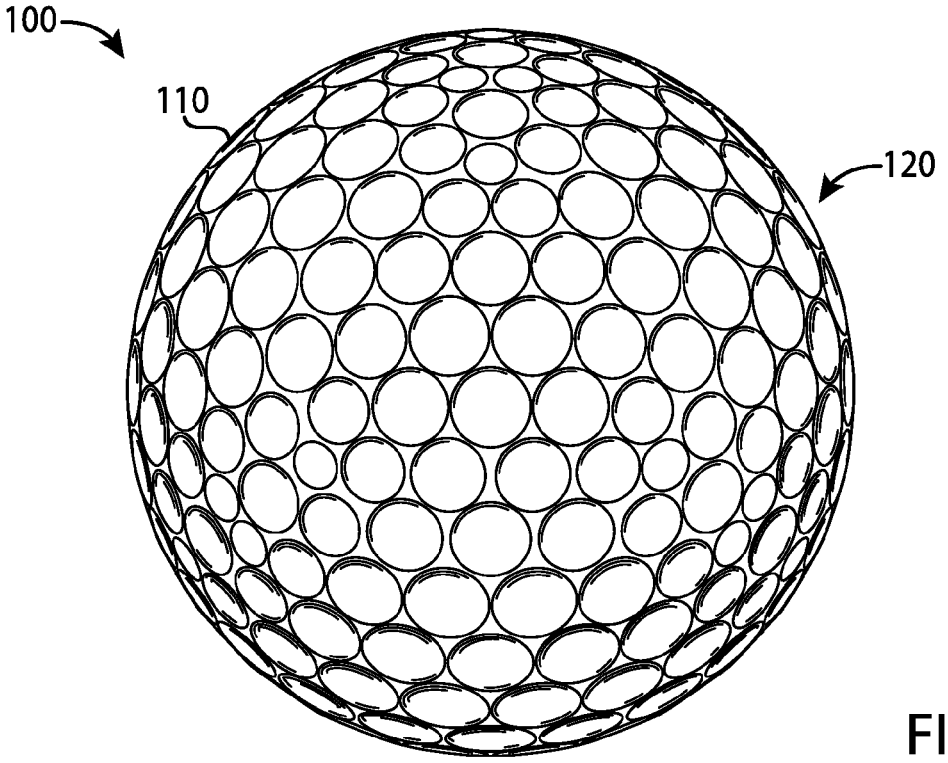
FIG. 3 depicts a side view of the example golf ball of FIG. 1.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf balls and methods to manufacture golf balls are described herein. The apparatus, methods, and articles of manufacture described herein are not limited in this regard.

In the example of FIGS. 1-5, a golf ball 100 may include an outside surface 110 and a plurality of dimples 120. In particular, the outside surface 110 may include a plurality of quadrant regions (e.g., FIG. 2) with a first set of quadrant regions (one shown as 400 in FIGS. 2, 4, and 6), and a second set of quadrant regions (one shown as 500 in FIGS. 2, 5, and 6). In one example, the plurality of dimples 120 may include 300 dimples configured in a tetrahedral-type dimple pattern. The plurality of dimples 120 may include more or less dimples configured in other suitable type of dimple patterns. The golf ball 100 may include multiple layers (e.g., a two-piece golf ball, a three-piece golf ball, a four-piece golf ball, a five-piece golf ball, etc.). In one example, the golf ball 100 may be a four-piece golf ball including a polybutadiene core, an inner ionomer mantle, an outer ionomer mantle, and a thermoset urethane cover. The apparatus, methods, and articles of manufacture described herein are not limited in this regard.

Figure 4:
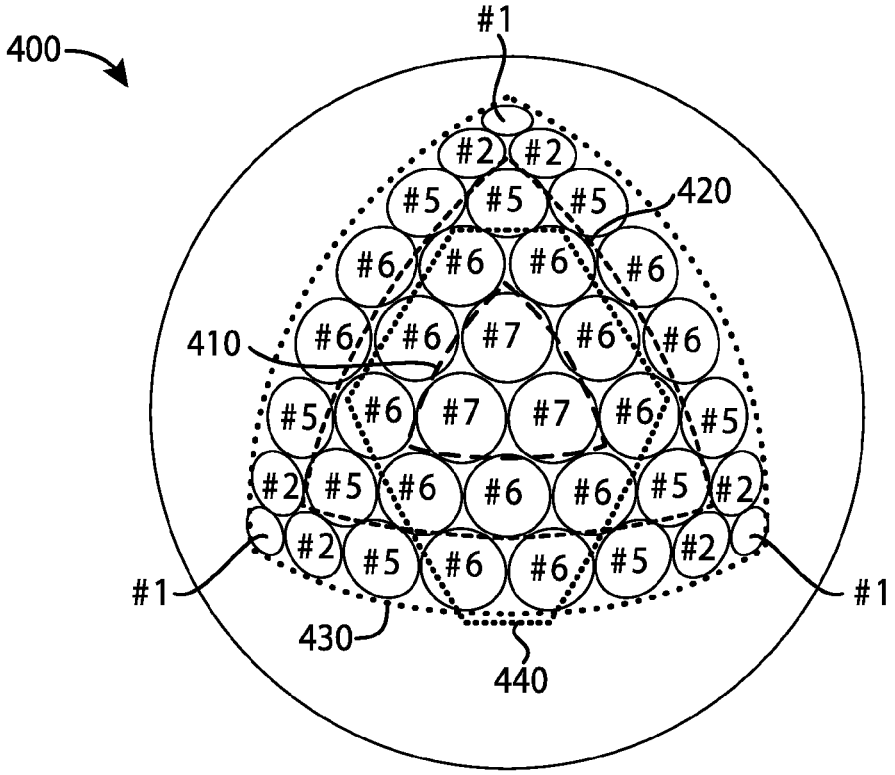
FIG. 4 depicts an example first quadrant region of the example golf ball of the FIG. 1.

In one example as shown in FIG. 4, the plurality of dimples 120 may include dimples with seven different diameters. In particular, a first set of dimples (generally shown as Dimple

#1) may be associated with a first dimple diameter, a second set of dimples (generally shown as Dimple #2) may be associated with a second dimple diameter, a third set of dimples (generally shown as Dimple #3) may be associated with a third dimple diameter, a fourth set of dimples (generally shown as Dimple #4) may be associated with a fourth dimple diameter, a fifth set of dimples (generally shown as Dimple #5) may be associated with a fifth dimple diameter, a sixth set of dimples (generally shown as Dimple #6) may be associated with a sixth dimple diameter, and a seventh set of dimples (generally shown as Dimple #7) may be associated with a seventh dimple diameter.

In contrast to other golf balls, the golf ball 100 may include relatively less number of dimples but relatively larger dimples. In particular, the smallest dimple diameter may be less than 0.120 inch whereas the largest dimple diameter may be greater than 0.200 inch. For example, the largest dimple diameter may be at least 80% greater than the smallest dimple diameter. At least 90% of the plurality of dimples 120 may be associated with a dimple diameter greater than the smallest dimple diameter. Further, at least 50% of the plurality of dimples may be greater than or equal to 0.180 inch. With relatively larger dimples, the golf ball 100 may have less number of dimples than other golf balls.

To illustrate the above example, the plurality of dimples 120 may include twenty-four (24) dimples of Dimple #1, seventy-two (72) dimples of Dimple #2, thirty-six (36) dimples of Dimple #3, thirty-six (36) dimples of Dimple #4, sixty (60) dimples of Dimple #5, sixty (60) dimples of Dimple #6, and twelve (12) dimples of Dimple #7. The first dimple diameter may be about 0.114 inch, the second dimple diameter may be about 0.154 inch, the third dimple diameter may be about 0.174 inch, the fourth dimple diameter may be about 0.180 inch, the fifth dimple diameter may be about 0.186 inch, the six dimple diameter may be about 0.198 inch, and the seventh dimple diameter may be about 0.208 inch. The first dimple diameter (i.e., Dimple #1) may be the smallest dimple diameter whereas the seventh dimple diameter (i.e., Dimple #7) may be the largest dimple diameter. The seventh dimple diameter may be at least 80% greater than the first dimple diameter. As described in detail below, the plurality of dimples 120 may be configured in a tetrahedral-type dimple pattern. In particular, the tetrahedral-type dimple pattern may include four (4) first quadrant regions (shown as 400 in FIGS. 2, 4, and 6), and four (4) second quadrant regions (shown as 500 in FIGS. 2, 5, and 6).

Figure 6:
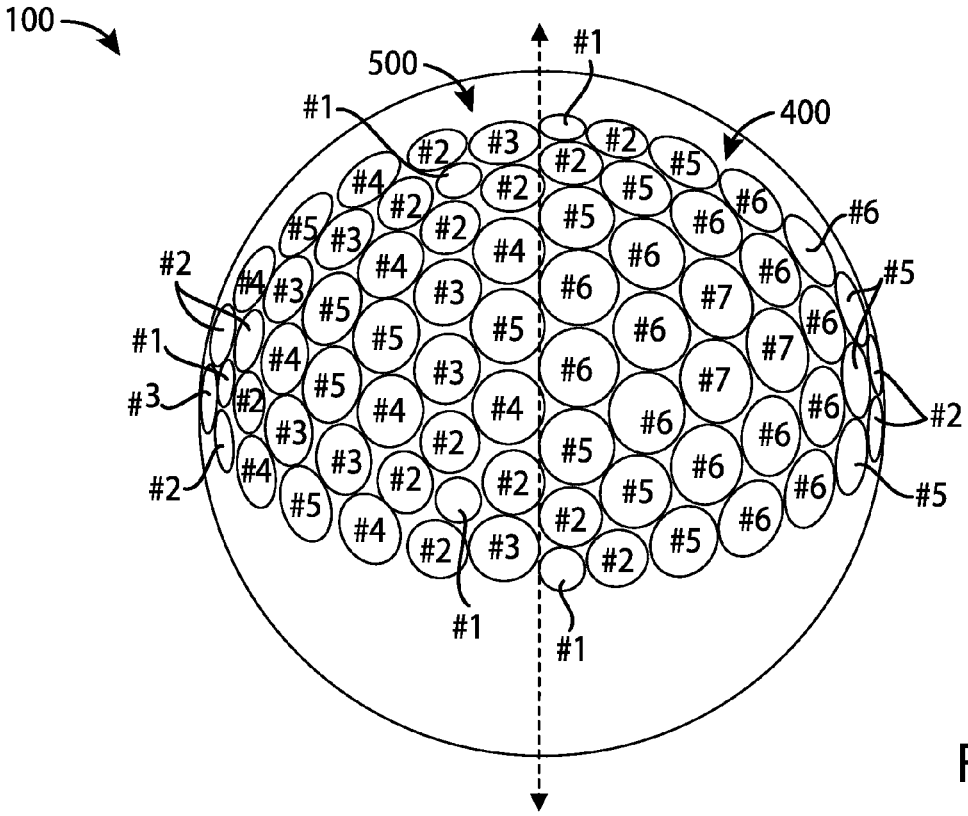
FIG. 6 depicts the example first and second quadrant regions of the example golf ball of FIG. 1.

Turning to FIGS. 4 and 6, for example, each first quadrant region 400 may include three triangular regions formed by thirty-six (36) dimples. In particular, the first quadrant region 400 may include a first triangular region 410, a second triangular region 420, and a third triangular region 430. The first quadrant region 400 may include three (3) dimples of Dimple #1, six (6) dimples of Dimple #2, nine (9) dimples of Dimple #5, fifteen (15) dimples of Dimple #6, and three (3) dimples of Dimple #7. The three dimples of Dimple #7 may be centrally located in the first quadrant region 400 to form the first triangular region 410. The first triangular region 410 may be an equilateral triangular region (e.g., three equal sides). The first triangular region 410 may be surrounded by the second triangular region 420 formed by nine dimples of Dimple #6 as the sides with three dimples of Dimple #5 as the vertices. Accordingly, the vertices of the second triangular region 420 may be smaller dimples than the dimples forming the sides of the second triangular region 420, and the dimples forming the sides of the second triangular region 420 may have the same size. The second triangular region 420 may be an equilateral triangular region. The third triangular region 430 may surround the first and second triangular regions 410 and 420, respectively. The third triangular region 430 may include three dimples of Dimple #1, six dimples of Dimple #2, six dimples of Dimple 45, and six dimples of Dimple #6. Each dimple of Dimple #1 may form a vertex of the third triangular region 430. Each side of the third triangular region 430 may include two dimples of Dimple #2, two dimples of Dimple #5, and two dimples of Dimple #6. The third triangular region 430 may be an equilateral triangular region.

According to the example of FIG. 4, the vertices of the triangular region 430 may have smaller dimples than the dimples forming the sides of the triangular region 430. Further, the size of the dimples of the triangular region 430 may increase from each vertex toward the center portion of each side of the triangular region 430 (e.g., Dimple #1 to Dimple #2 to Dimple #5 to Dimple #6). Two similar sized dimples may define the center portion of each side of the triangular region 430 (e.g., two dimples of Dimple #6). The dimples of the first quadrant region 400 may decrease in size from the first triangular region 410 toward the vertices and the sides of the third triangular region 430. That is, the largest dimples of the first quadrant region 400 (e.g., Dimple #7) may be located in the first triangular region 410, and the smallest dimples of the of the first quadrant region 400 (e.g., Dimples #1 and #2) may be located proximate to the vertices of the third triangular region 430. A hexagonal region 440 (e.g., ten dimples of Dimple #6) may define the center portion of the first quadrant region 400. The apparatus, methods, and articles of manufacture described herein are not limited in this regard.

Figure 5:
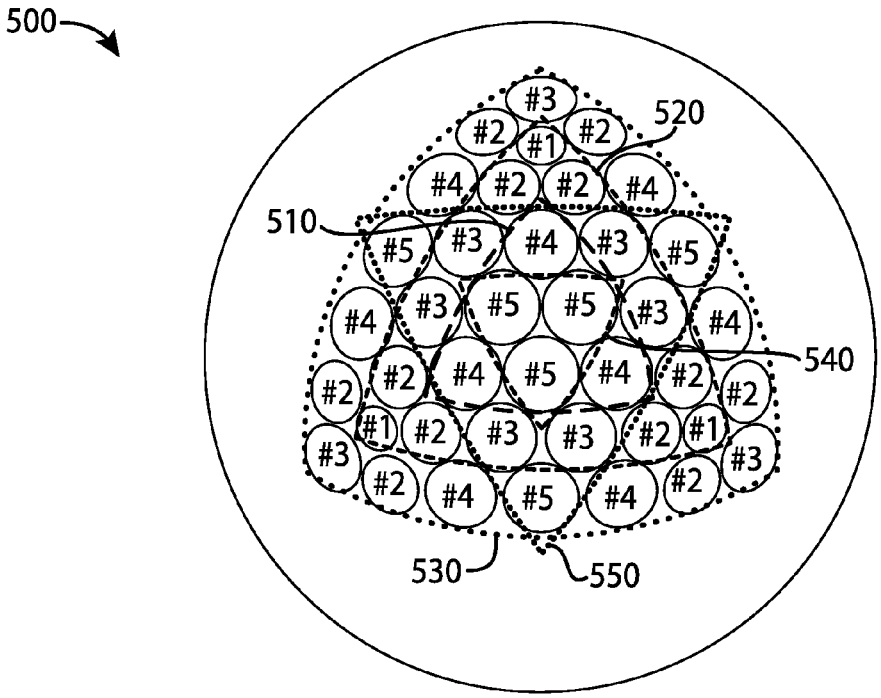
FIG. 5 depicts an example second quadrant region of the example golf ball of FIG. 1.

Referring to FIGS. 5 and 6, for example, each second quadrant region 500 may include three triangular regions formed by thirty-nine (39) dimples. In particular, the second quadrant region 500 may include a first triangular region 510, a second triangular region 520, and a third triangular region 530. The second quadrant region 500 may include three (3) dimples of Dimple 41, twelve (12) dimples of Dimple 42, nine (9) dimples of Dimple #3, nine (9) dimples of Dimple #4, and six (6) dimples of Dimple #5. Three dimples of Dimple #4 and three dimples of Dimple #5 may form the first triangular region 510 of the second quadrant region 500 with the three dimples of Dimple #4 as the vertices. The first triangular region 520 may be an equilateral triangular region. The first triangular region 510 may be surrounded by the second triangular region 520 formed by six dimples of Dimple #2 and six dimples of Dimple #3 with three dimples of Dimple #1 as the vertices. The second triangular region 520 may be an equilateral triangular region. The third triangular region 530 may surround the first and second triangular regions 510 and 520, respectively. The third triangular region 530 may include six dimples of Dimple #2, three dimples of Dimple #3, six dimples of Dimple #4, and three dimples of Dimple #5. Each dimple of Dimple #3 may form a vertex of the third triangular region 530. Each side of the third triangular region 530 may include two dimples of Dimple #2, two dimples of Dimple #4, and one dimple of Dimple #5. The third triangular region 530 may be an equilateral triangular region.

The dimples located at the vertices of the third triangular region 530 may be dimples of Dimple #3, which may not be the smallest dimples that define the third triangular region 530. According to the example of FIG. 5, the smallest dimples in the third triangular region 530 may be dimples of Dimple #2, which may be located on the sides of the third triangular region 530. Thus, the size of the dimples located on the sides of the third triangular region 530 may not uniformly increase from the vertices to the center portions of the sides. The vertices of the second triangular region 520 may define the smallest dimples of the second quadrant region 500 (e.g., dimples of Dimple #1). The size of the dimples of the second triangular region 520 may increase from each vertex to a center portion, which may be defined by two similarly sized dimples (e.g., dimples of Dimple #3). A center portion of the second quadrant region 500 may include three dimples of Dimple #5, which may define a fourth triangular region 540. The fourth triangular region 540 may be inverted relative to the triangular regions 510, 520, and 530. A dimple of Dimple #5 may define each vertex of the fourth triangular region 540. The fourth triangular region 540 may be an equilateral triangular region. The second quadrant region 500 may also include a fifth triangular region 550. The fifth triangular region 550 may be inverted relative to the triangular regions 510, 520, and 530. A dimple of Dimple #5 may define each vertex of the fifth triangular region 550. Two dimples of Dimple #3 and a center dimple of Dimple #4 may define each side of the fifth triangular region 550, which may be similar to the other two sides. The fifth triangular region 550 may be an equilateral triangular region. The apparatus, methods, and articles of manufacture described herein are not limited in this regard.

Figure 7:
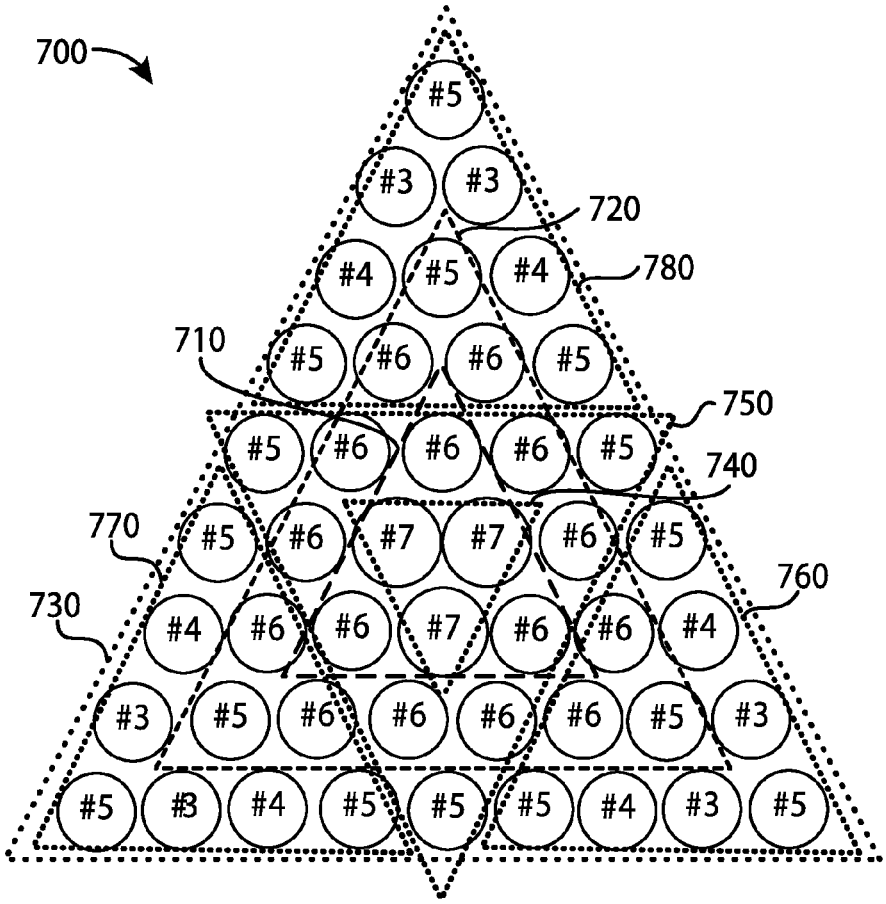
FIG. 7 depicts an example face region of the example golf ball of FIG. 1.
Figure 8:
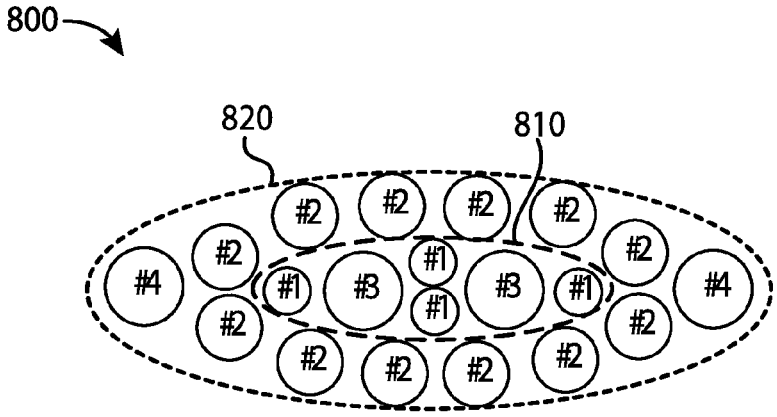
FIG. 8 depicts an example edge region of the example golf ball of FIG. 1.

In another example, the outside surface 110 may include four face regions (one shown as 700 in FIG. 7), and six edge regions (one shown as 800 in FIG. 8). Referring to FIG. 7, for example, each face region 700 may include three triangular regions formed by 45 dimples. In particular, the face region 700 may include a first triangular region 710, a second triangular region 720, and a third triangular region 730. The first triangular region 710 may be formed by six (6) dimples, the second triangular region 720 formed by fifteen (15) dimples, and the third triangular region 730 formed by twenty-four (24) dimples. The first triangular region 710 may include three (3) dimples of Dimple #6, and three (3) dimples of Dimple #7. The first triangular region 710 may be an equilateral triangular region. The second triangular region 720 may include three (3) dimples of Dimple #5, and twelve (12) dimples of Dimple #6. The second triangular region 720 may be an equilateral triangular region. The third triangular region 730 may include six (6) dimples of Dimple #3, six (6) dimples of Dimple #4, and twelve (12) dimples of Dimple #5. The third triangular region 730 may be an equilateral triangular region.

The face region 700 may be divided into triangular regions 740, 750, 760, 770, and 780. Triangular regions 740 and 750 may be inverted relative to the triangular regions 760, 770, and 780. The triangular regions 740 and 750 may be equilateral triangular regions whereas the triangular regions 760, 770, and 780 may be isosceles triangular regions (e.g., two equal sides). One dimple of Dimple #5 may define each vertex of each of the triangular regions 760, 770, and 780. Two dimples of Dimple #6 may define one side of each of the triangular regions 760, 770, and 780. One dimple of Dimple #3 and one dimple of Dimple #4 may define the other two sides of the triangular regions 760, 770, and 780. Each of the triangular regions 760, 770, and 780 may have a center dimple of Dimple #5. The triangular regions 760, 770, and 780 may surround the triangular region 750, which may include vertices defined by dimples of Dimple #5 and sides defined by three dimples of Dimple #6. Three dimples of Dimple #7 may define the triangular region 740. The triangular region 750 may surround the triangular region 740. The apparatus, methods, and articles of manufacture described herein are not limited in this regard.

Turning to FIG. 8, for example, each edge region 800 may include two elliptical regions formed by twenty (20) dimples. In particular, the edge region 800 may include a first elliptical region 810 formed by six (6) dimples, and a second elliptical region 820 formed by fourteen (14) dimples. The first elliptical region 810 may include four (4) dimples of Dimple #1, and two (2) dimples of Dimple #3. The second elliptical region 820 may include twelve (12) dimples of Dimple #2, and two (2) dimples of Dimple #4. The apparatus, methods, and articles of manufacture described herein are not limited in this regard.

Figure 9:
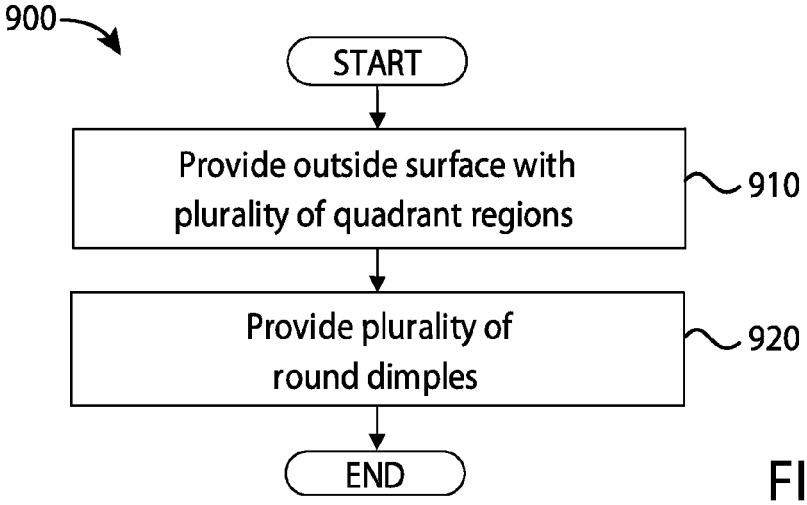
FIG. 9 depicts one manner in which the example golf ball described herein may be manufactured.

FIG. 9 depicts one manner in which the golf ball 100 may be manufactured. In the example of FIG. 9, the process 900 may begin with providing an outside surface with a plurality of quadrant regions (block 910). The plurality of quadrant regions may define a tetrahedral-type dimple pattern. The plurality of quadrant regions may include a first set of quadrant regions and a second set of quadrant regions. In one example, each of the first set of quadrant regions 400 may include thirty-six (36) dimples whereas each of the second set of quadrant regions 500 may include thirty-nine (39) dimples.

The process 900 may provide a plurality of round dimples formed on the outside surface (block 920). The process 900 may configure the plurality of dimples being in the tetrahedral-type dimple pattern. In one example, dimples associated with the largest dimple diameter may be centrally located in each quadrant region of the first set of quadrant regions 400, and dimples associated with the smallest dimple diameter may form vertices of each quadrant region of the second set of quadrant regions 500. At least 90% of the total number of dimples may have a dimple diameter that may be greater than about 0.12 inch, which according to one example may be the minimum dimple diameter. Accordingly, the process 900 may form at least 90% of the total number of dimples with dimples associated with a dimple diameter of about 0.150 inch or greater. Further, the process 900 may form at least 50% of the total number of dimples with dimples having a dimple diameter greater than about 0.180 inch or greater. The apparatus, methods, and articles of manufacture described herein are not limited in this regard.

The example process 900 of FIG. 9 is merely provided and described as an example of one way to manufacture the golf ball 100. While a particular order of actions is illustrated in FIG. 9, these actions may be performed in other temporal sequences. For example, two or more actions depicted in FIG. 9 may be performed sequentially, concurrently, or simultaneously. Although FIG. 9 depicts a particular number of blocks, the process may not perform one or more blocks. The apparatus, methods, and articles of manufacture described herein are not limited in this regard.

Golf balls may be packaged and sold in various ways. In particular, a package of golf balls may include half a dozen golf balls, a dozen golf balls, fifteen golf balls, two-dozen golf balls, etc. Further, a package of golf balls may be divided into sleeves of golf balls. For example, a package of a dozen golf balls may include four sleeves of golf balls with each sleeve including three visually identical golf balls. The golf balls in one sleeve may be marked differently from the golf balls in another sleeve for identification purposes (e.g., marked with a single-digit number). In one example, each golf ball in a first sleeve of a package with a dozen golf balls may include the number "1," each golf ball in a second sleeve of the package may include the number "2," each golf ball in a third sleeve of the package may include the number "3," and each golf ball in a fourth sleeve of the package may include the number "4." While golf balls may be marked to differentiate the golf balls between two or more sleeves in a package, the package may include at least two or more visually identical golf balls.

Figure 10:
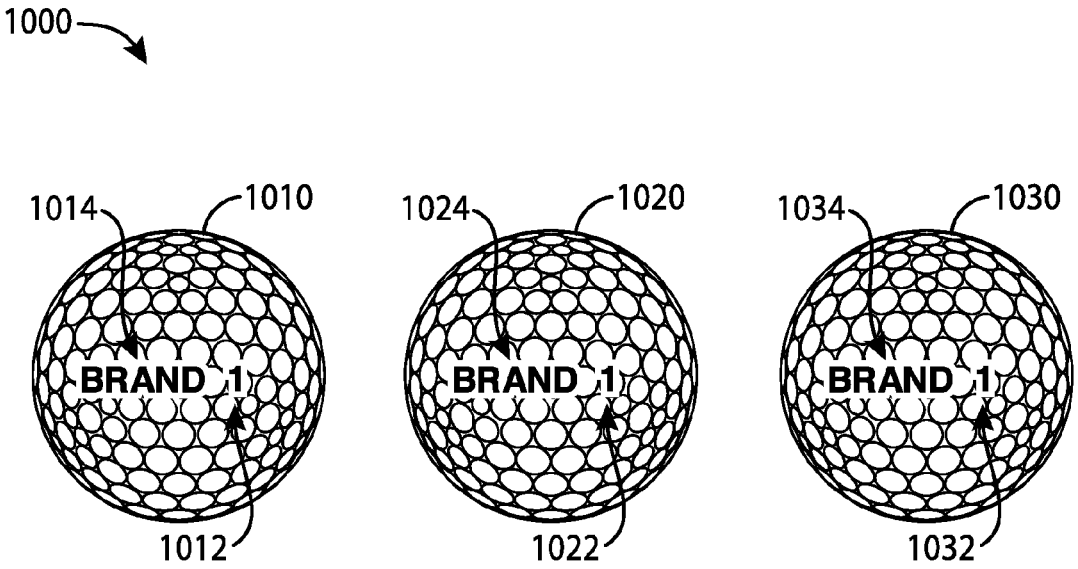
FIG. 10 depicts an example sleeve of golf balls according to an embodiment of the apparatus, methods, and articles of manufacture described herein.

Referring to FIG. 10, for example, a sleeve of golf balls 1000 may include two or more golf balls, generally shown as 1010, 1020, and 1030. As mentioned above, a package of golf balls may include two or more sleeves of golf balls. To differentiate from golf balls in other sleeves of the package, each golf ball of the sleeve 1000 may include a ball identifier associated with the sleeve 1000. In particular, the ball identifiers, generally shown as a first ball identifier 1012, a second ball identifier 1022, and a third ball identifier 1032, may be an identification character such as a number, a letter, a symbol, a logo, any combination thereof, and/or other suitable type of identifiers. For example, the ball identifiers 1012, 1022, and 1032 may be a single-digit number (e.g., "1"). The ball identifiers 1012, 1022, and 1032 may be adjacent to the brand name (e.g., "BRAND") of the golf balls 1010, 1020, and 1030, generally shown as 1014, 1024, and 1034, respectively. Instead of being either above or below the brand name as with some golf balls, the ball identifiers 1012, 1022, and 1032 may be located left of the brand names 1014, 1024, and 1034, respectively. The apparatus, methods, and articles of manufacture described herein are not limited in this regard.

Although the golf balls 1010, 1020, and 1030 of the sleeve 1000 may be physically identical (i.e., the golf balls 1010, 1020, and 1030 may have substantially the same physical characteristics and perform about the same), the ball identifiers 1012, 1022, and 1032 may be used to differentiate the golf balls 1010, 1020, and 1030 of the sleeve 1000. In contrast to other golf balls, however, each of the ball identifiers 1012, 1022, and 1032 may include a visual effect to identify and further differentiate the golf balls 1010, 1020, and 1030 of the sleeve 1000 (i.e., differentiate the golf balls 1010, 1020, and 1030 from each other). In particular, the first ball identifier 1012 may be associated with a first visual effect, the second ball identifier 1022 may be associated with a second visual effect, and the third ball identifier 1032 may be associated with a third visual effect. For example, the ball identifiers 1012, 1022, and 1032 may be different colors (i.e., color effect). That is, the first visual effect may be a first color, the second visual effect may be a second color, and the third visual effect may be a third color. The first, second, and third colors may be different from each other. As illustrated in FIG. 10, for example, the first color may be a red color, the second color may be a blue color, and the third color may be a black color. Accordingly, the first ball identifier 1012 may be the number "1" in a red color, the second ball identifier 1022 may be the number "1" in a blue color, and the third ball identifier 1032 may be the number "1" in a black color. The ball identifiers 1012, 1022, and 1032 may be used to identify the golf balls 1010, 1020, and 1030 of the sleeve 1000, respectively. As a result, the probability of two or more individuals playing with visually identical golf balls may be reduced when the individuals play with the same brand of golf balls.

While the above example may describe ball identifiers with different colors, one or more of the ball identifiers 1012, 1022, and 1032 may have other visual effects such as text effect (e.g., outline, bold, italic, underline, etc.). For example, the ball identifier 1032 of the golf ball 1030 may be the number "1" in a white color with an outline of the number "1" in a black color as the outer surface of the golf ball 1030 may be in a white color. Further, while FIG. 10 may depict a particular number of golf balls, the apparatus, methods, and articles of manufacture described herein may include more or less golf balls. The apparatus, methods, and articles of manufacture are not limited in this regard.

Although some golf balls in a sleeve and/or a package may be color-coded to identify golf balls with different physical characteristics that may perform differently, the apparatus, methods, and articles of manufacture described herein may applicable to identify physically identical golf balls. With the ball identifiers 1012, 1022, and 1032 as described herein, other markings on the golf balls 1010, 1020, and 1030 (e.g., markings via pens, markers, stamps, stickers, etc.) may not be necessary to further identify the golf balls 1010, 1020, and 1030.

Figure 11:
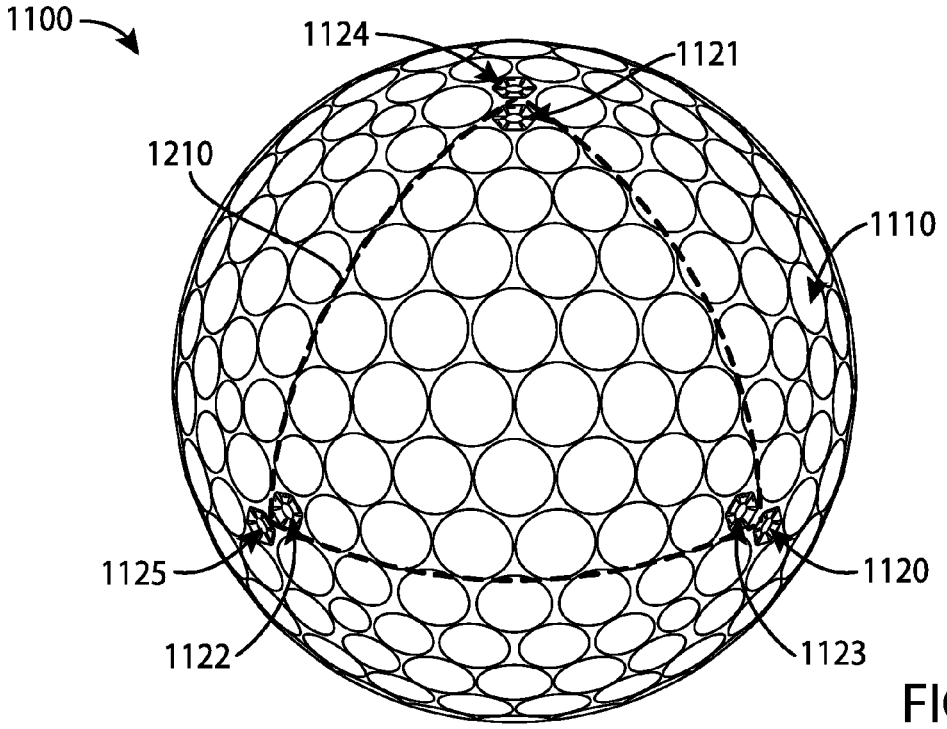
FIG. 11 depicts a front view of an example golf ball according to another embodiment of the apparatus, methods, and articles of manufacture described herein.
Figure 12:
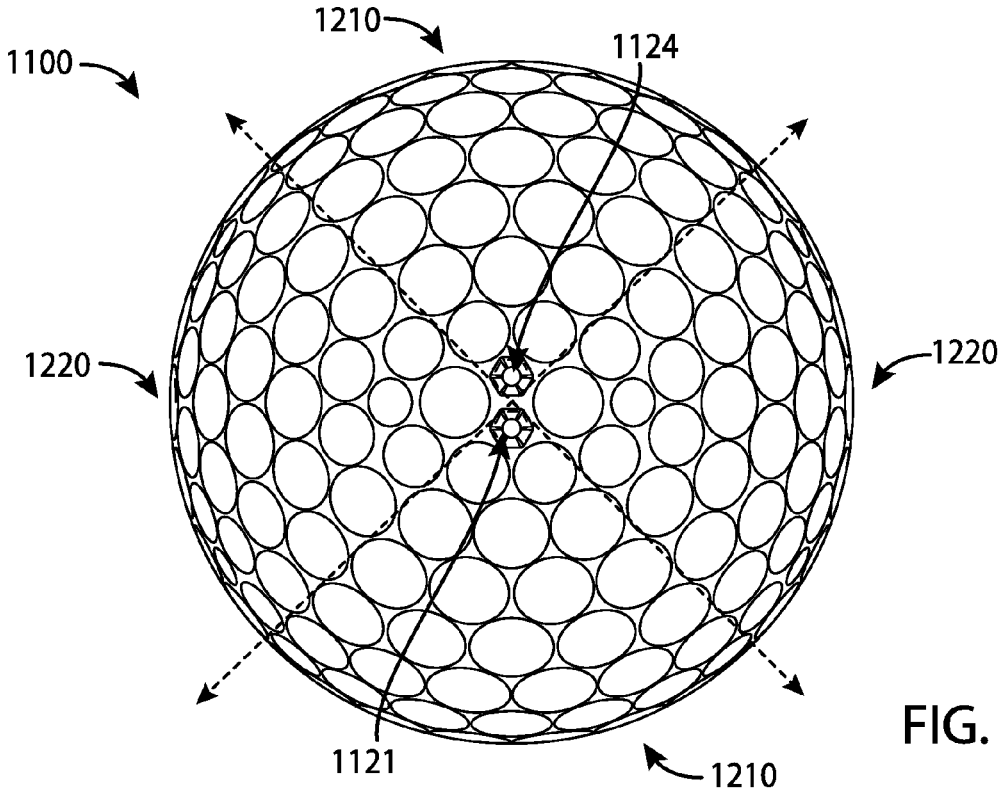
FIG. 12 depicts a top view of the example golf ball of FIG. 11.
Figure 13:
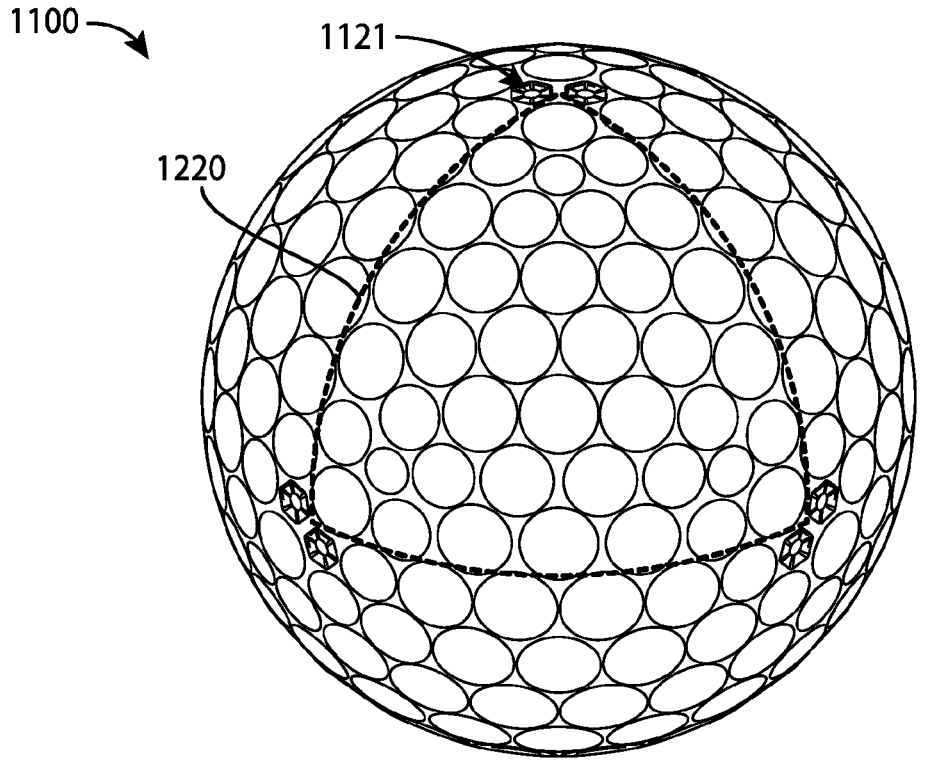
FIG. 13 depicts a side view of the example golf ball of FIG. 11.

Launch monitor systems may use various technologies to track golf balls (e.g., ultra-high speed cameras, radar, etc.). Some launch monitor systems may operate in conjunction with markings on golf balls to determine launch conditions and data. Turning to FIGS. 11-13, for example, a golf ball 1100 may include a plurality of round dimples, generally shown as 1110 (e.g., circular-shaped dimples). Each round dimple of the plurality of round dimples 1110 may have a dimple diameter (i.e., a straight line segment through the center of a round shape). At least one round dimple of the plurality of round dimples 1110 may be associated with a minimum dimple diameter length (i.e., the smallest round dimple). The golf ball 1100 may also include a plurality of non-round dimples, generally shown as 1120. Each non-round dimple of the plurality of non-round dimples 1120 may have a dimple diagonal (i.e., a straight line segment joining two opposite corners of a non-round shape). At least one non-round dimple of the plurality of non-round dimples 1120 may be associated with a maximum dimple diagonal length (i.e., the largest non-round dimple). The minimum dimple diameter length may be greater than or equal to the maximum dimple diagonal length. That is, the smallest round dimple may circumscribe the largest non-round dimple (i.e., the largest non-round dimple may inscribe in the smallest round dimple).

The golf ball 1100 may include a plurality of quadrant regions. In particular, the plurality of quadrant regions may include a first set of quadrant regions (one shown as 1210 in FIG. 11), and a second set of quadrant regions (one shown as 1220 in FIG. 13). Each non-round dimple of the plurality of non-round dimples 1120 may be a vertex of each quadrant region of the first set of quadrant regions. In one example, the non-round dimples 1121, 1122, and 1123 may be the vertices of the quadrant region 1210.

Instead of markings on the golf balls, launch monitor systems may use the plurality of non-round dimples 1120 to determine launch conditions and data of the golf ball 1100. The non-round dimples 1120 may be used to distinguish from the round dimples 1110. In one example, the plurality of non-round dimples 1120 may be hexagonal dimples, generally shown as 1121, 1122, 1123, 1124, and 1125. The golf ball 1100 may include twelve (12) hexagonal dimples. Each non-round dimple may be adjacent to another non-round dimple. For example, the non-round dimple 1121 may be adjacent to the non-round dimple 1124 and vice versa. In another example, the non-round dimple 1122 may be adjacent to the non-round dimple 1125 and vice versa. The apparatus, methods, and articles of manufacture described herein are not limited in this regard.

Figure 14:
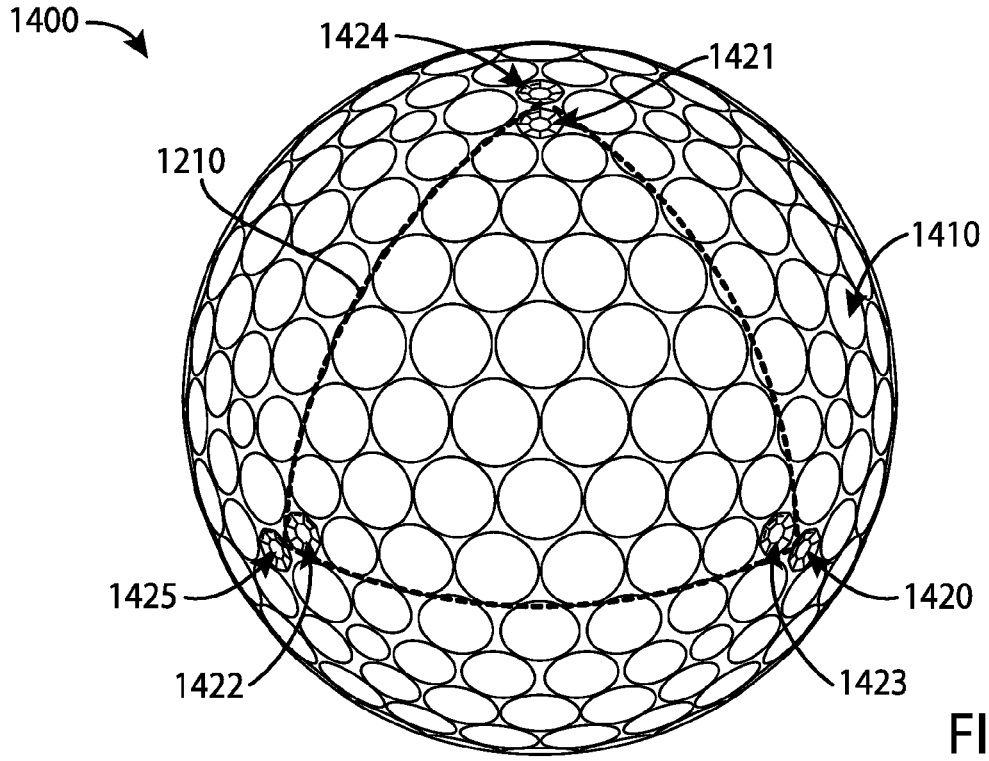
FIG. 14 depicts a front view of an example golf ball according to yet another embodiment of the apparatus, methods, and articles of manufacture described herein.
Figure 15:
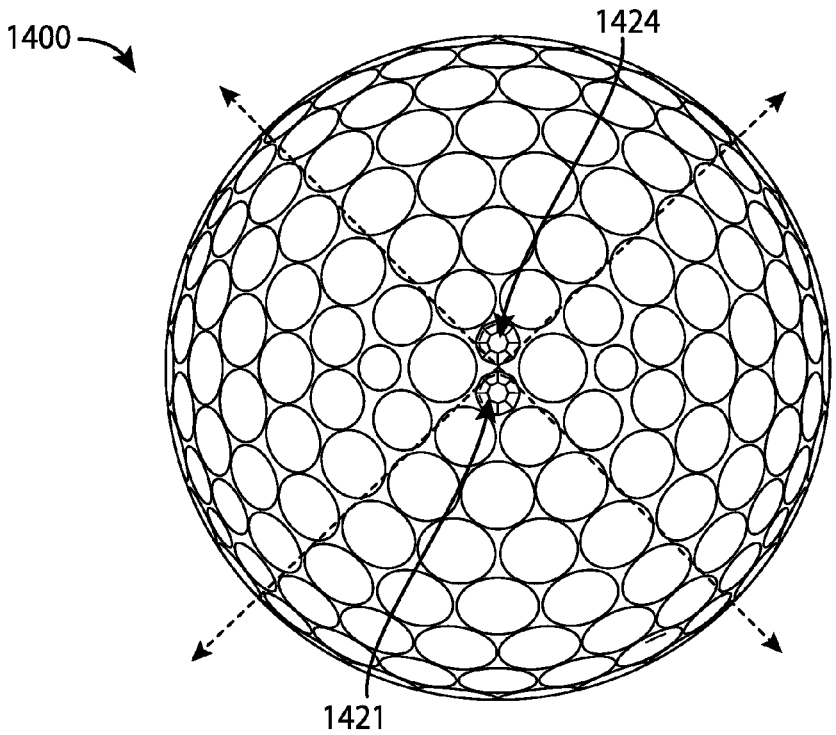
FIG. 15 depicts atop view of the example golf ball of FIG. 14.
Figure 16:
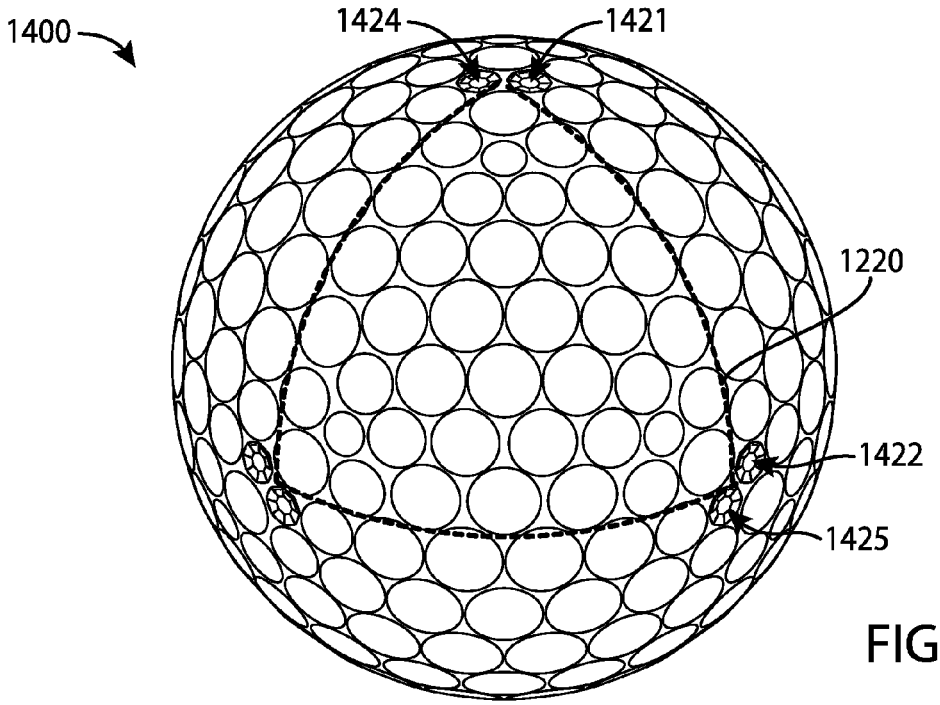
FIG. 16 depicts a side view of the example golf ball of FIG. 14.

Alternatively, the plurality of non-round dimples may be other shapes (e.g., other polygon shapes). As illustrated in FIGS. 14-16, for example, a golf ball 1400 may include a plurality of round dimples, generally shown as 1410, and a plurality of non-round dimples, generally shown as 1420. In one example, the plurality of non-round dimples 1420 may be octagon-shaped dimples, generally shown as 1421, 1422, 1423, 1424, and 1425. The golf ball 1400 may include twelve (12) octagon-shaped dimples. Each non-round dimple may be adjacent to another non-round dimple. For example, the non-round dimple 1421 may be adjacent to the non-round dimple 1424 and vice versa. In another example, the non-round dimple 1422 may be adjacent to the non-round dimple 1425 and vice versa. While FIGS. 11-16 may depict symmetrical dimples, the plurality of non-round dimples 1120 and/or 1420 may be asymmetrical dimples. The apparatus, methods, and articles of manufacture are not limited in this regard.

Referring to FIGS. 17-20, for another example, a golf ball 1700 may include an outside surface 1710 and a plurality of dimples 1720. The outside surface 1710 may include a plurality of quadrant regions, with a first set of quadrant regions 1810, and a second set of quadrant regions 1820. The quadrant regions 1810 and 1820 and the plurality of dimples 1720 of the golf ball 1700 may be similar in many respects to the quadrant regions 400 and 500 and plurality of dimples 120 of the golf ball 100, respectively. Accordingly, a detailed description of similar features of the quadrants regions and the plurality of dimples of the golf balls 1700 and 100 is not provided. The golf ball 1700 may include a plurality of round dimples (generally shown as 1722), and a plurality of non-round dimples (generally shown as 1822). In one example, the plurality of non-round dimples 1822 may be hexagonal dimples. However, any of the non-rounded dimples discussed herein including the non-round dimples 1822 may have any symmetrical or asymmetrical non-rounded shape. Additionally, the non-round dimples 1822 may be similar or different in size and/or shape. For example, the golf ball 1700 may include twenty-four (24) non-round dimples 1822. The apparatus, methods, and articles of manufacture are not limited in this regard.

Figure 17:
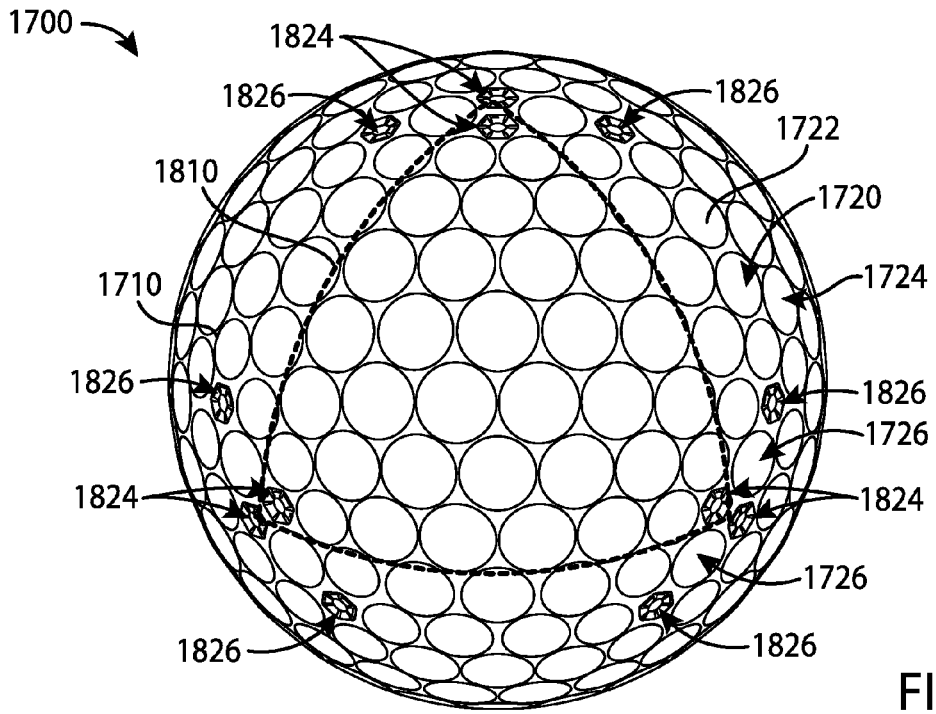
FIG. 17 depicts a front view of an example golf ball according to yet another embodiment of the apparatus, methods, and articles of manufacture described herein.
Figure 18:
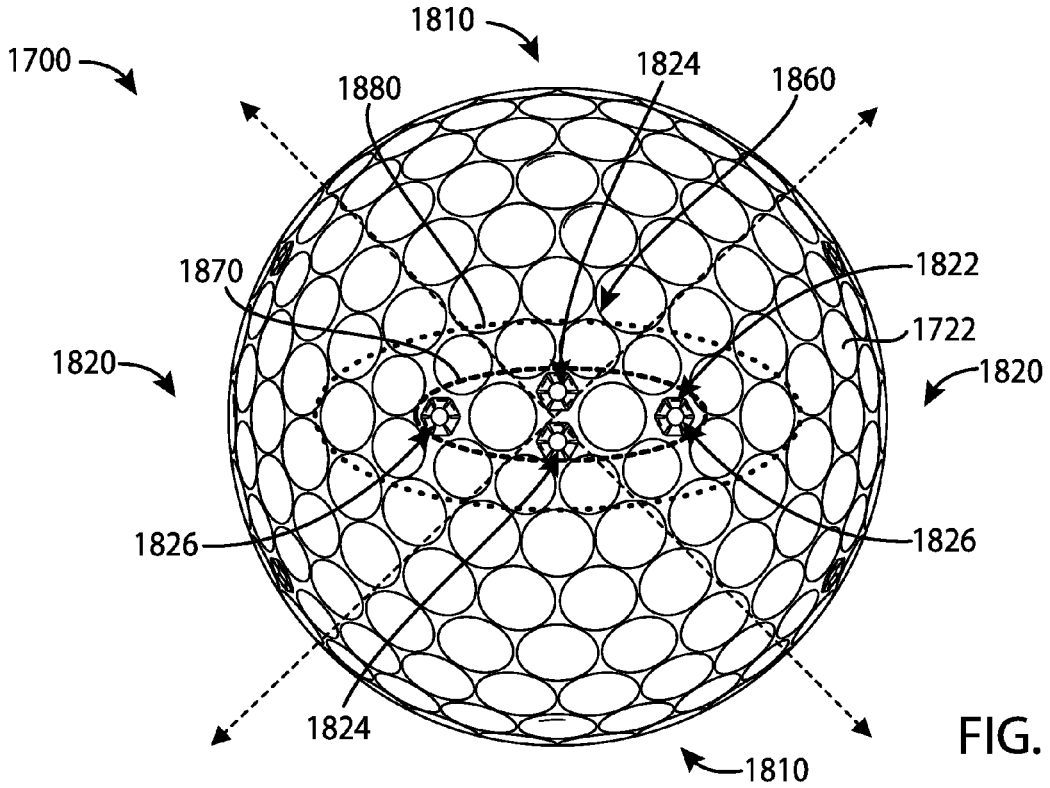
FIG. 18 depicts a top view of the example golf ball of FIG. 17.

In particular, each of the quadrant regions 1810 and 1820 may include at least three (3) non-round dimples 1822. The non-round dimples 1822 of the first quadrant regions 1810 may be generally shown as dimples 1824, and the non-round dimples 1822 of the second quadrant region may be generally shown as dimples 1826. The non-round dimples 1822 may define a triangular region in each of their respective quadrants. Referring to FIG. 17, the dimples 1824 define the vertices of first quadrant region 1810, which may be shown as a triangular region. The sides of the triangular region defined by the dimples 1824 may include round dimples. Further, the sides of the triangular region defined by the dimples 1824 may include similar dimple sizes and dimple pattern as the other two sides of the triangular region defined by the dimples 1824. That is, the dimples 1824 may define the vertices of an equilateral triangular region 1810.

Figure 19:
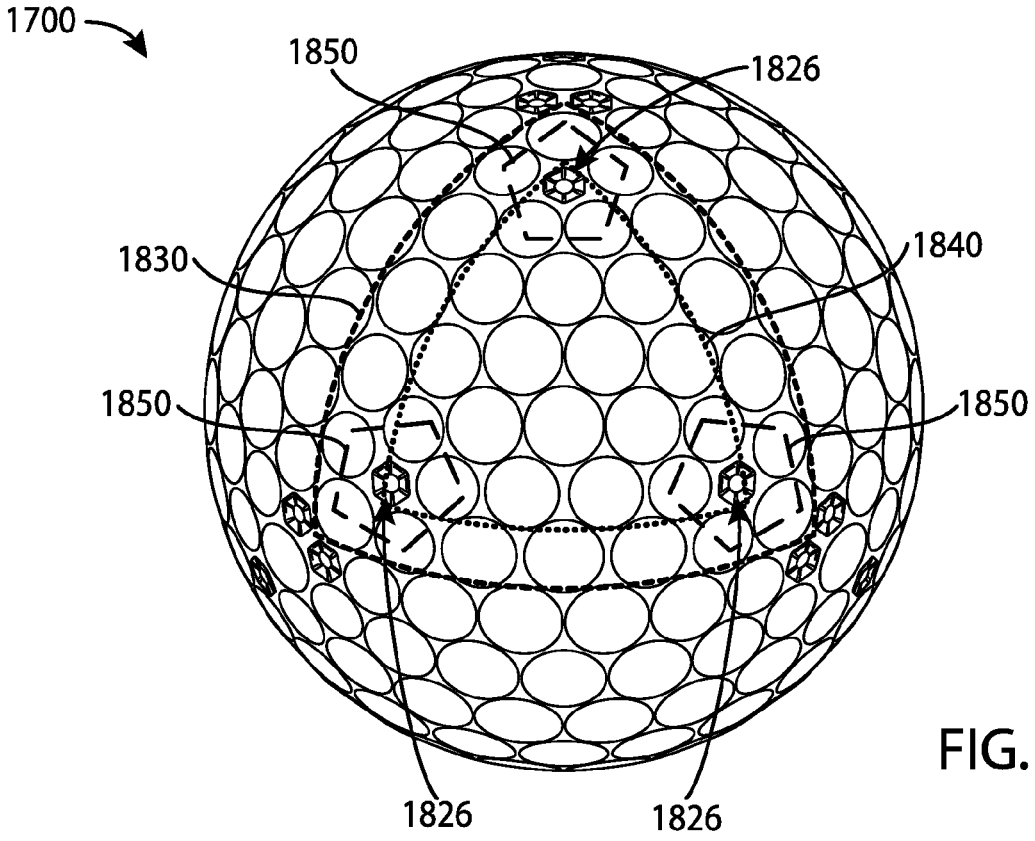
FIG. 19 depicts a side view of the example golf ball of FIG. 17.

Each of the dimples 1824 of the first quadrant region 1810 may be adjacent to a dimple 1824 of an adjacent first quadrant region 1810. As illustrated in FIG. 19, for example, each of the second quadrant regions 1830 may include three (3) dimples 1826 that define a triangular region 1840. The triangular region 1840 may be smaller than the second quadrant region 1830. The sides of the triangular region 1840 may include round dimples. Further, the sides of the triangular region 1840 may include similar dimple sizes and dimple pattern as the other two sides of the triangular region 1840. That is, the dimples 1826 may define the vertices of an equilateral triangular region 1840 within the second quadrant region 1830. The triangular region 1840 may be similar to the triangular region 520 of the second quadrant region 500 of the golf ball 100, except for having the non-round dimples 1826.

Each round dimple of the plurality of round dimples 1722 may be surrounded by at least six (6) dimples (round and/or non-round dimples) (e.g., hexagonal packing). In one example, the hexagonal packing of a round dimple 1724 may include all round dimples. Seven (7) dimples may surround some round dimples of the plurality of round dimples 1722, generally shown as 1726 (e.g., heptagonal packing). The heptagonal packing of a round dimple 1726 may include at least one non-round dimple. For example, each of the round dimples 1726 may be surrounded by four (4) round dimples and three (3) non-round dimples. In contrast to the plurality of round dimples 1722, five (5) dimples (round and/or non-round dimples) may surround each non-round dimple of the plurality of non-round dimples 1822 of the golf ball 1700 (e.g., pentagonal packing). In particular, five (5) round dimples may surround each non-round dimple of the non-round dimples 1826 to define a pentagonal region 1850 inside the second quadrant region 1830 (e.g., pentagonal packing). That is, the pentagonal packing of the non-round dimples 1826 may include all round dimples. Each of the second quadrant regions 1830 may include three pentagonal regions 1850. As a result, the golf ball 1700 may include twelve (12) pentagonal regions 1850. While five (5) dimples may also surround each non-round dimple of the non-round dimples 1824, the pentagonal packing of the non-round dimples 1824 may include at least one non-round dimple.

Turning back to FIG. 18, for example, the outside surface 1710 may include six edge regions 1860. Each edge region 1860 may include two elliptical regions formed by twenty (20) dimples. In particular, the edge region 1860 may include a first elliptical region 1870 formed by six (6) dimples, and a second elliptical region 1880 formed by fourteen (14) dimples. The first elliptical region 1870 may overlap two adjacent first quadrant regions 1810 and two adjacent second quadrant regions 1820 such that the first elliptical region may include two (2) non-round dimples 1824, two (2) non-round dimples 1826, and two (2) round dimples. Thus, the non-round dimples 1824 and 1826 of adjacent quadrant regions 1810 and 1820 may define the first elliptical region 1870. The second elliptical region 1880 of the golf ball 1700 may be similar in many respects to the second elliptical region 820 of the golf ball 100. Accordingly, a detailed description of the second elliptical region 1880 is not provided. The apparatus, methods, and articles of manufacture described herein are not limited in this regard.

The non-round dimples 1824 and 1826, the configuration of the non-round dimples 1824 and 1826 in triangular regions (e.g., vertices of triangular regions), and/or the configuration of the non-round dimples 1824 and 1826 in pentagonal regions 1850 may assist launch monitor systems to track golf balls (e.g., high-resolution cameras with stereoscopic lens). To determine flight information of a golf ball, a launch monitor system may capture subsequent images of a flight path of the golf ball, analyze each image to locate the golf ball, and compare successive images. Comparing high-resolution images may be used to determine spin rate and spin direction of a golf ball whereas comparing low-resolution images captured at a relatively faster frame rate may be used to determine speed and direction of the golf ball. Further, images of the golf ball at an address position (e.g., position before flight) may be analyzed to identify one or more non-round dimples that may used as reference dimple(s) to establish reference coordinates. For example, an image of the golf ball in the address position may include one of the elliptical regions 1870. Accordingly, one of the non-round dimples in the elliptical region 1870 may be used as a reference dimple. Further, the non-round dimples in the image may be identified relative to the reference dimple. The non-round dimples that are not visible in the image may be determined relative to the reference dimple because the positions of the non-round dimples of the golf ball may be known relative to each other as described herein. Each image of the golf ball during flight may be used to determine the location of the reference dimple and to identify the non-round dimples that appear in the image by determining the location of the non-round dimples relative to the reference dimple. Analyzing locations of the non-round dimples relative to the reference dimple and/or relative to each other in successive high-resolution images of the golf ball during flight may be used to determine spin direction velocity, and/or acceleration of the golf ball. Further, analyzing images of the golf ball with successive high-frame rate, low-resolution images may be used to determine velocity, acceleration, and/or distance traveled by the golf ball.

In one example, tracking the translation and rotation of each pentagonal region 1850 relative to the other pentagonal regions 1850 in each triangular region 1830 by analyzing successive images of the golf ball may provide a launch monitor system with data to compute translational and rotational velocities and accelerations of a golf ball. Velocity and acceleration data of a golf ball may be used to determine golf swing characteristics of an individual and/or trajectory of the golf ball. The apparatus, methods, and articles of manufacture described herein are not limited in this regard.

Figure 20:
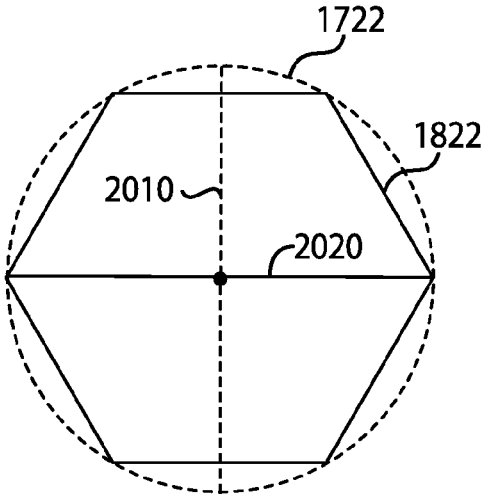
FIG. 20 depicts an example non-round dimple of the example golf ball of FIG. 17.

As shown in FIG. 20, each round dimple of the plurality of round dimples 1722 may have a dimple diameter 2010 (i.e., a straight line segment through the center of a round shape). At least one round dimple of the plurality of round dimples 1722 may be associated with a minimum dimple diameter length ($DM_{min}$) (i.e., the smallest round dimple). Each non-round dimple of the plurality of non-round dimples 1822 may have a dimple diagonal 2020 (i.e., a straight line segment joining two opposite corners of a non-round shape). At least one non-round dimple of the plurality of non-round dimples 1822 may be associated with a maximum dimple diagonal length ($DG_{max}$) (i.e., the largest non-round dimple). The minimum dimple diameter length may be greater than or equal to the maximum dimple diagonal length (i.e., $DM_{min} \geq DG_{max}$). That is, the smallest round dimple may circumscribe the largest non-round dimple (i.e., the largest non-round dimple may inscribe in the smallest round dimple). The apparatus, methods, and articles of manufacture described herein are not limited in this regard.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments. Further, the terms "and" and "or" may have both conjunctive and disjunctive meanings.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described with respect to golf balls, the apparatus, methods and articles of manufacture described herein may be applicable to other suitable types of sports equipment. The apparatus, methods, and articles of manufacture described herein may be applicable to other types of balls (e.g., basketball balls, soccer balls, table-tennis balls, tennis balls, etc.).

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf ball comprising:

an outside surface having a plurality of quadrant regions having a first set of quadrant regions and a second set of quadrant regions; and a plurality of dimples having a plurality of round dimples with each round dimple having a dimple diameter and a plurality of non-round dimples with each non-round dimple having a dimple diagonal, at least one round dimple being associated with a minimum dimple diameter length, and at least one non-round dimple being associated with a maximum dimple diagonal length, wherein each vertex of each quadrant region of the first set of quadrant regions includes a non-round dimple of the plurality of non-round dimples, wherein each side of each quadrant region of the plurality of quadrant regions comprises round dimples of the plurality of round dimples, wherein the round dimples of each side of each quadrant region are adjacent to the round dimples of an adjacent side of an adjacent quadrant region, wherein each quadrant region of the second set of quadrant regions includes at least one pentagonal region defined by a non-round dimple defining a center dimple of the pentagonal region and five round dimples surrounding and being adjacent to the center dimple, each of the five round dimples having a center to define a vertex of a substantially regular pentagon, and wherein the minimum dimple diameter length is greater than or equal to the maximum dimple diagonal length.

2. A golf ball as defined in claim 1, wherein the plurality of non-round dimples comprises at least one hexagonal dimple.

3. A golf ball as defined in claim 1, wherein the dimple diagonals of the plurality of non-round dimples comprise dimple diagonals with substantially the same length.

4. A golf ball as defined in claim 1, wherein the plurality of dimples comprise less than about 10% of non-round dimples.

5. A golf ball as defined in claim 1, wherein each non-round dimple of the plurality of non-round dimples is adjacent to at least one round dimple.

6. A golf ball as defined in claim 1, wherein the total number of dimples in each quadrant region of the second set of quadrant regions is greater than the total number of dimples in each quadrant region of the first set of quadrant regions.

7. A golf ball as defined in claim 1, wherein the total number of dimples in the second set of quadrant regions is more than 50% of the plurality of dimples.

8. A golf ball as defined in claim 1, wherein the total surface area covered by dimples associated with each quadrant region of the first set of quadrant regions is greater than the total surface area covered by dimples associated with each quadrant region of the second set of quadrant regions.

9. A golf ball as defined in claim 1, wherein at least 90% of the total number of dimples are associated with a dimple diameter of about 0.150 inch or greater.

10. A golf ball as defined in claim 1, wherein at least 50% of the total number of dimples are associated with a dimple diameter of about 0.180 inch or greater.

11. A golf ball as defined in claim 1, wherein the plurality of dimples comprise less than about 325 dimples.

12. A golf ball comprising:

an outside surface having a plurality of quadrant regions having a first set of quadrant regions and a second set of quadrant regions; and a plurality of dimples having a plurality of round dimples and at least one non-round dimple in each quadrant region, each round dimple having a dimple diameter, and the least one non-round dimple having a dimple diagonal, wherein the at least one non-round dimple of each quadrant of the first set of quadrant regions is a vertex of the quadrant region of the first set of quadrant regions, wherein at least one round dimple of each quadrant of the second set of quadrant regions is a vertex of the quadrant region of the second set of quadrant regions, wherein the at least one non-round dimple is adjacent to the at least one round dimple, and wherein the shortest dimple diameter is greater than or equal to the longest dimple diagonal.

13. A golf ball as defined in claim 12, wherein the at least one non-round dimple comprises a hexagonal dimple.

14. A golf ball as defined in claim 12, wherein the at least one non-round dimple is less than 10% of the plurality of dimples.

15. A golf ball as defined in claim 12, wherein each non-round dimple of the plurality of non-round dimples is adjacent to at least one round dimple.

16. A golf ball comprising:

an outside surface having a plurality of quadrant regions having a first set of quadrant regions and a second set of quadrant regions, a plurality of non-round dimples, each quadrant region of the plurality of quadrant regions comprising three non-round dimples, the three non-round dimples of each quadrant region of the second set of quadrant regions defining vertices of a triangular region, and a plurality of round dimples, each side of each quadrant region of the plurality of quadrant regions comprising round dimples having different diameters, wherein each side of each triangular region comprises a plurality of round dimples, each side of each triangular region having the same dimple pattern as the other two sides of the triangular region.

17. A golf ball as defined in claim 16, wherein each quadrant region of the first set of quadrant regions comprises vertices defined by non-round dimples.

18. A golf ball as defined in claim 12, wherein each quadrant region of the second set of quadrant regions includes at least one non-round dimple being a center of a substantially regular pentagonal region surrounded by five dimples.

19. A golf ball as defined in claim 16, wherein each quadrant region of the second set of quadrant regions comprises a substantially regular pentagonal region having a non-round dimple at a center of the pentagonal region, the non-round dimple being surrounded by five round dimples.

20. A golf ball as defined in claim 16, wherein the plurality of non-round dimples comprises at least one hexagonal dimple.

* * * * *